US006278353B1

(12) United States Patent
Downing et al.

(10) Patent No.: US 6,278,353 B1
(45) Date of Patent: Aug. 21, 2001

(54) PLANAR MAGNETICS WITH INTEGRATED COOLING

(75) Inventors: Robert S. Downing; Gregory I. Rozman, both of Rockford, IL (US)

(73) Assignee: Hamilton Sundstrand Corporation, Rockford, IL (US)

( * ) Notice: Subject to any disclaimer, the term of this patent is extended or adjusted under 35 U.S.C. 154(b) by 0 days.

(21) Appl. No.: 09/441,710

(22) Filed: Nov. 16, 1999

(51) Int. Cl.[7] ..... H01F 5/00; H01F 27/02
(52) U.S. Cl. ..... 336/200; 336/59; 336/60
(58) Field of Search ..... 336/59, 58, 60, 336/57, 61, 200

(56) References Cited

U.S. PATENT DOCUMENTS

| | | | | |
|---|---|---|---|---|
| 3,539,959 | * | 11/1970 | Wildi | 336/60 |
| 3,644,156 | * | 2/1972 | Petrinjak et al. | 156/90 |
| 3,858,138 | * | 12/1974 | Gittleman et al. | 336/136 |
| 4,025,379 | * | 5/1977 | Whetstone | 29/609 |
| 4,482,879 | | 11/1984 | Jackowicz | 336/55 |
| 4,577,175 | | 3/1986 | Burgher et al. | 336/61 |
| 4,736,176 | | 4/1988 | Aubert | 335/299 |
| 4,754,390 | | 6/1988 | Felton et al. | 363/141 |
| 4,794,358 | | 12/1988 | Steingroever et al. | 335/299 |
| 4,910,642 | | 3/1990 | Downing | 361/382 |
| 4,956,626 | | 9/1990 | Hoppe et al. | 336/60 |
| 5,010,314 | | 4/1991 | Estrov | 336/198 |
| 5,066,904 | * | 11/1991 | Bullock | 324/127 |
| 5,097,241 | | 3/1992 | Smith et al. | 336/60 |
| 5,126,714 | | 6/1992 | Johnson | 336/83 |
| 5,430,426 | | 7/1995 | Griebel | 336/232 |
| 5,473,302 | | 12/1995 | Terlop et al. | 336/183 |

OTHER PUBLICATIONS

Power Transformer is Small, PCIM, pp. 20, 22, Aug. 1986.
Prior Art Multisource Technology Corporation Brochure, p. 2, Feb. 1, 1992.
Ben–Yaakov, The Benefits of Planar Magnetics in HF Power Conversion, pp. 1–7, 1996.

* cited by examiner

*Primary Examiner*—Michael L. Gellner
*Assistant Examiner*—Anh Mai
(74) *Attorney, Agent, or Firm*—Marshall O'Toole Gerstein Murray & Borun

(57) ABSTRACT

A planar magnetic device including a planar conductive winding and planar cooling element is disclosed. The planar cooling element includes a number of cooling layers some of which may have apertures therein to create a passage that accommodates fluid flow. In operation, coolant is pumped through the passage of the planar cooling element to remove heat from the planar magnetic device.

4 Claims, 9 Drawing Sheets

PLANAR MAGNETICS WITH INTEGRATED COOLING

FIELD OF THE INVENTION

The present invention relates generally to planar magnetic devices and, more particularly, to planar magnetic devices having integrated cooling.

BACKGROUND OF THE INVENTION

Traditionally, magnetic devices have been fabricated by wrapping a conductor (e.g., a wire) around a core material (e.g., ferrite) that has a relatively high magnetic permeability. Recently, with the miniaturization of many electrical products, the need for compact magnetic devices has arisen. One specific compact magnetic device is a planar magnetic (PM) transformer. The PM transformer uses interconnected planar layers of electrical conductors, rather than relatively bulky wire, disposed around magnetic core material to create primary and secondary windings. PM transformers are typically used in applications such as switching power supplies that are commonly found in many consumer and industrial products.

As is the case in many electrical applications, power dissipation that generates heat in the windings and the core is a consideration when using PM devices. Excessive heat caused by such power dissipation can damage the PM device itself as well as other components or circuitry located proximate thereto. This heat is typically dissipated through the use of a heat sink attached to the outside of the PM transformer. PM transformers are advantageous in that they provide a relatively large and planar surface area to which a heat sink may be fastened. However, even if a PM transformer is fitted with the best heat sink available, the PM transformer will still generate heat that cannot be dissipated without excessive internal heating of the PM transformer because the heat sink can only reduce the external surface temperatures of the PM transformer. Accordingly, the current, and therefore the power, that may be handled by a given PM transformer having a heat sink will be reduced from the power that the same PM transformer could handle given a more effective technique of extracting heat from the device.

SUMMARY OF THE INVENTION

According to one aspect of the present invention, a planar magnetic device includes a planar conductive winding and a planar cooling element separate from the planar conductive winding having a passage therethrough to accommodate a flow of a coolant, the planar cooling element being disposed adjacent the planar conductive winding.

The planar cooling element includes first and second cooling layers wherein one of the cooling layers includes a relieved portion having an outer periphery and forming a channel that is capable of accommodating the coolant. The planar cooling element may further include a third cooling layer having an aperture therein, the third cooling layer being disposed between the first and second cooling layers, wherein the aperture has an outer periphery substantially coincident with the outer periphery of the relieved portion.

The first and second cooling layers may each include relieved portions having coincident outer peripheries that form the channel that is capable of accommodating the coolant.

The planar conductive winding has a first footprint and the planar cooling element has a second footprint and wherein the second footprint substantially includes the first footprint. The planar conductive winding and the planar cooling element are fabricated of copper and may have a dielectric insulator disposed between the planar conductive winding and the planar cooling element. The dielectric insulator may be polyimide, aramid or ceramic.

The first and second cooling layers may be bonded together by a diffusion bonding process or by a brazing process or by adhesive. Alternatively, the first and second cooling layers may be clamped together.

According to a further aspect of the present invention, a planar cooling device for use in a planar transformer includes first and second cooling layers wherein one of the first and second cooling layers includes a relieved portion having an outer periphery and forming a channel that is capable of accommodating a coolant.

DETAILED DESCRIPTION OF THE PREFERRED EMBODIMENT

Figure 1:
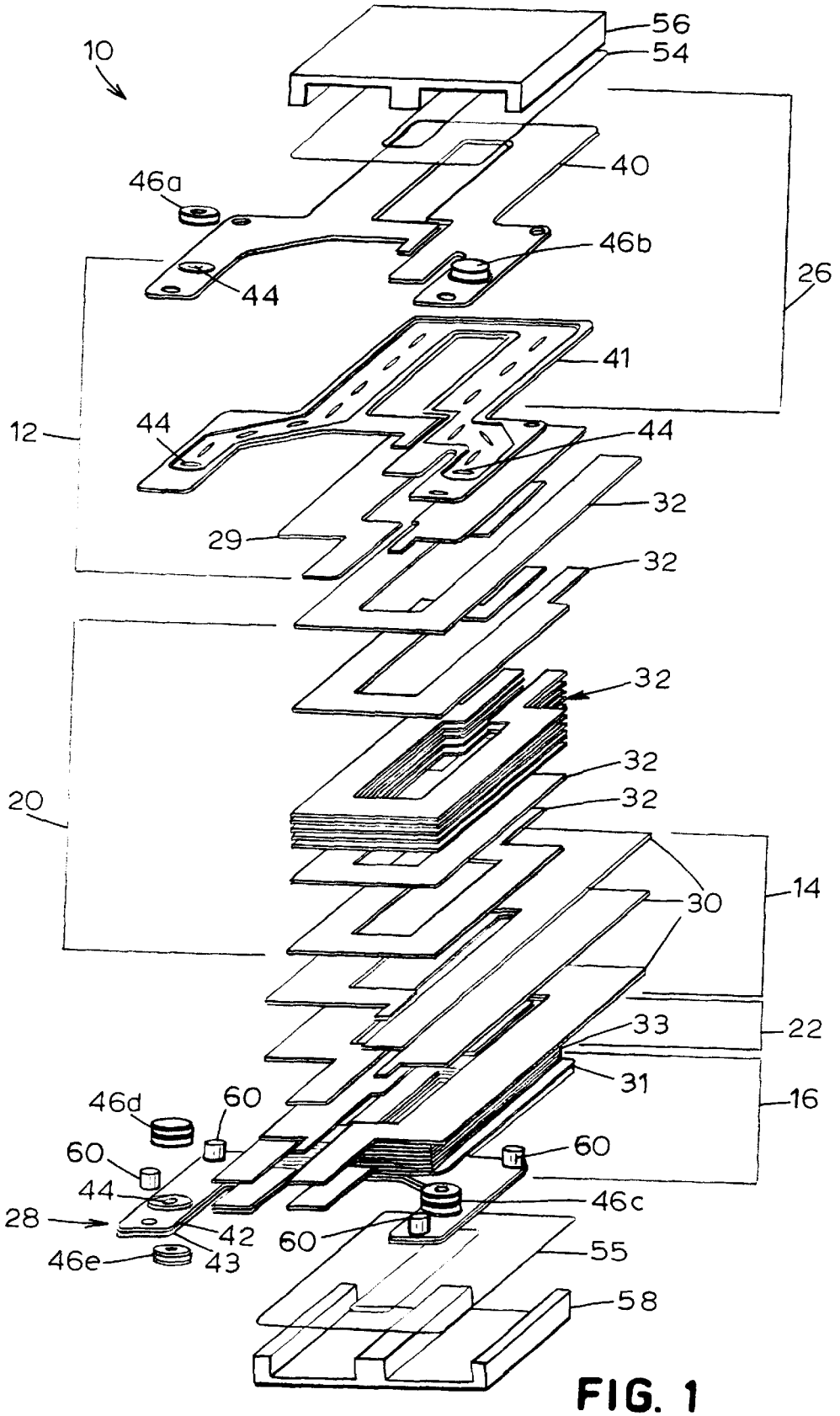
FIG. 1 is an exploded trimetric view of a PM transformer having integrated cooling according to a first embodiment of the present invention.
Figure 2:
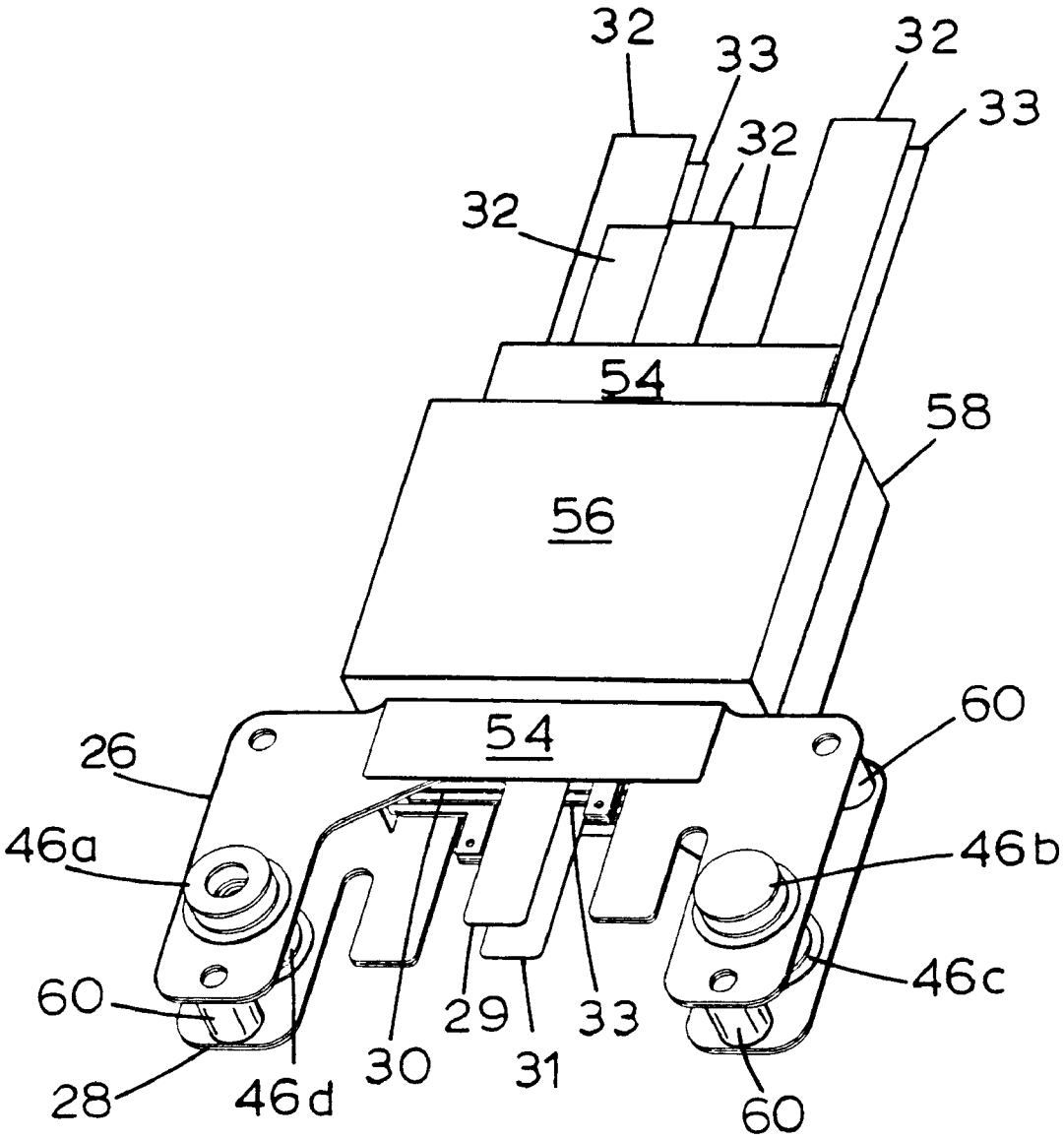
FIG. 2 is a trimetric view of the assembled PM transformer shown in FIG. 1.
Figure 3:
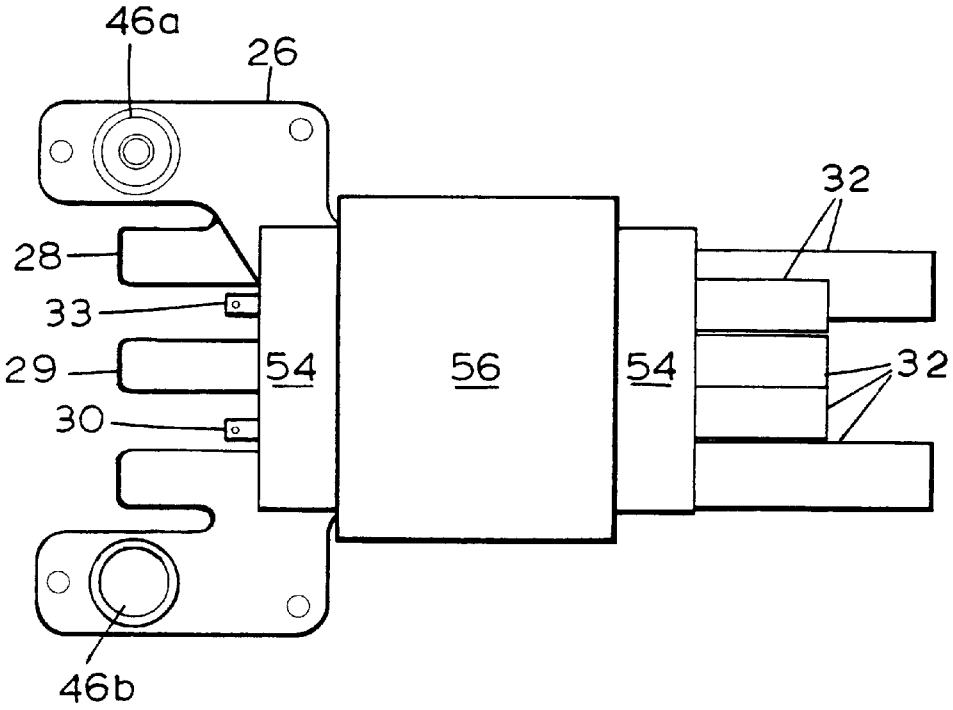
FIG. 3 is a plan view of a PM transformer shown in FIG. 2.
Figure 4:
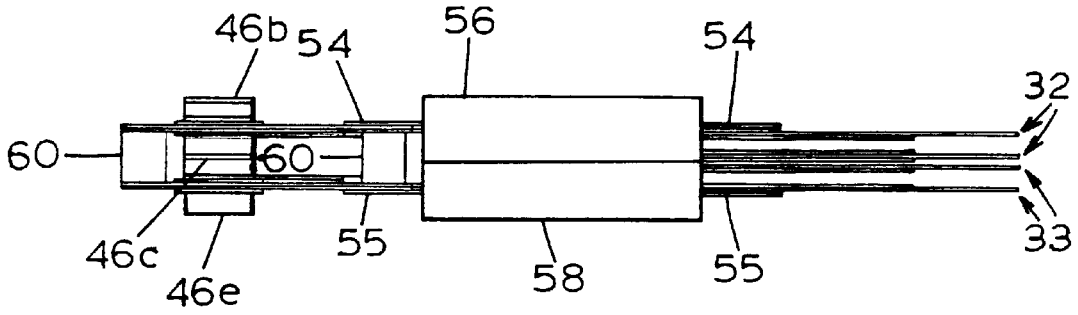
FIG. 4 is a side elevational view of the PM transformer shown in FIG. 2.

The present invention is directed to a planar magnetic (PM) device having one or more cooling elements disposed therein. Although the following description is given with respect to PM transformers, one of ordinary skill in the art will readily appreciate that the teachings of the present invention may be applied to other PM devices, such as inductors.

Referring to FIGS. 1–4, a first embodiment of a PM transformer 10 having integrated cooling generally includes first, second and third sets of primary windings 12, 14, 16, respectively, and first and second sets of secondary windings 20, 22, respectively. The first and third sets of primary windings 12, 16 include cooling elements 26 and 28, shown as exploded and as assembled, respectively. The first, second and third sets of primary windings 12, 14, 16 include one or more primary winding layers 29, 30, 31, respectively, while each of the first and second sets of secondary windings 20, 22 include a number of secondary winding layers 32, 33, respectively. As will be appreciated by those of ordinary skill in the art, the number of sets of primary and secondary windings may vary from those shown. In addition, the number of windings of each set of primary and secondary windings may be selected to provide a desired turns ratio between each set of primary windings and each set of secondary windings.

The cooling element 26 includes top and bottom cooling layers 40, 41 and the cooling element 28 includes top and bottom cooling layers 42, 43, each of which may be fabricated from copper or one or more other thermally conductive, materials. Both cooling elements 26, 28 include channels through which coolant (e.g., Freons®, PAO, oil, Flourinerts®, water, glycol or other alcohol) may flow. Each of the top and bottom cooling layers 40, 41, 42, 43 includes a plurality of coolant flow holes 44 through which coolant may pass. Bushings 46, each of which may be solid or may have a bore therethrough, are soldered or brazed onto the top and bottom cooling layers 40, 41, 42, 43 in such a manner that the centers of the bushings 46 are axially aligned with the centers of the coolant flow holes 44. Bushings 46 having bores therethrough permit the flow of coolant between the cooling elements 26, 28 whereas solid bushings 46 may be used for mechanical support and for sealing the coolant inside the cooling elements 26, 28. For example, as shown in FIG. 1, bushings 46*a*, 46*c* and 46*e* have bores therethrough and bushings 46*b* and 46*d* are solid. Such an arrangement of bushing 46 allows coolant to be introduced through the bushing 46*a* and to flow through the cooling element 26 before it is transferred to the cooling element 28 through the bushing 46*c*. The coolant provided to the cooling element 28, in turn, flows through the cooling element 28 and is expelled from the cooling element 28 at the bushing 46*e*. Once the coolant has traversed the cooling element 26 and the cooling element 28 and is expelled from the cooling element 28, it may be cooled by any known means and, thereafter, may be recirculated through the cooling elements 26, 28. The bushings 46 may be fabricated of an electrically non-conductive material (such as ceramic) or may be of sandwiched construction including a core of ceramic and face layers of copper or other electrically conductive or non-conductive material disposed thereon. In any case, such a bushing 46 configuration allows two cooling elements that are not operated at the same voltage potential to be coupled to one another to share an electrically non-conductive coolant.

After the various windings of the planar transformer have been assembled, top and bottom insulators 54, 55 and top and bottom core members 56, 58 are fitted around the windings. Preferably the insulators 54, 55 are fabricated from polyimide (e.g., Kapton®, ML®, varnish), aramid (e.g., Nomex®) or ceramic. Additionally, supports 60 may be used to provide mechanical stability to the various components and, more particularly, provides mechanical support between cooling element 26 and cooling element 28. Preferably, the supports 60 are ceramic bushings that are soldered in place after the cooling elements 26, 28 are assembled.

Figure 5:
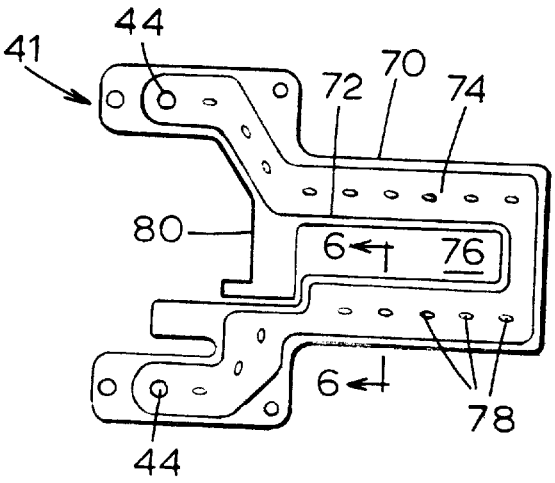
FIG. 5 is a plan view of a bottom layer of a cooling element used in the first embodiment of the PM transformer.
Figure 6:
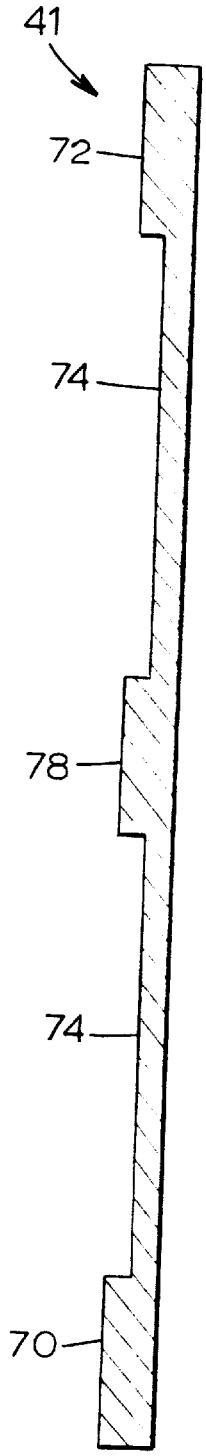
FIG. 6 is an enlarged cross sectional view of the bottom layer of the cooling element taken generally along the lines 6—6 of FIG. 5.

As shown in FIGS. 5 and 6, the bottom cooling layer 41 of a cooling element 26 includes an outer wall 70 and an inner wall 72 with a relieved portion 74 disposed therebetween and having an outer periphery. The relieved portion 74 may be created using a photochemical etching process. The outer and inner walls 70, 72 and the relieved portion 74 are arranged such that the bottom cooling layer 41 has a footprint having an open center portion 76 that accommodates center portions of the top and bottom core members 56, 58 when the PM transformer 10 is assembled. A number of ribs 78 (only one of which is shown in FIG. 6) are disposed within the relieved portion 74 to create a turbulent flow as coolant passes through an assembled cooling element 26. The amount of heat removed for a given temperature rise in the PM transformer 10 can be increased by providing additional ribs 78. Although the ribs 78 are shown as being substantially equidistant from the inner and outer walls 70, 72, in other embodiments the ribs 78 may be disposed in various patterns throughout the relieved portion 74.

The bottom cooling layer 41 includes an electrical connection tab 80 that connects an assembled cooling element 26 to one or more winding layers or winding sets in the PM transformer 10. For example, as shown in FIG. 1, the cooling element 26 may be connected one or more primary winding layers 29, 30, 31 to form a set of primary windings 12, 14 or 16. Alternatively, the cooling element 28 may be connected to secondary winding layers 32, 33.

Figure 7:
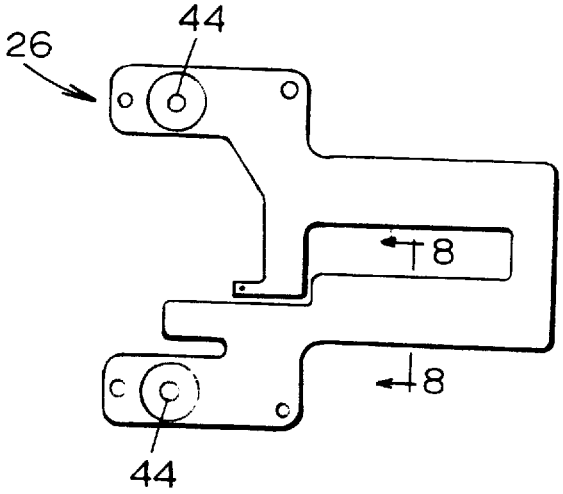
FIG. 7 is a plan view of an assembled cooling element used in the PM transformer of FIG. 1.
Figure 8:
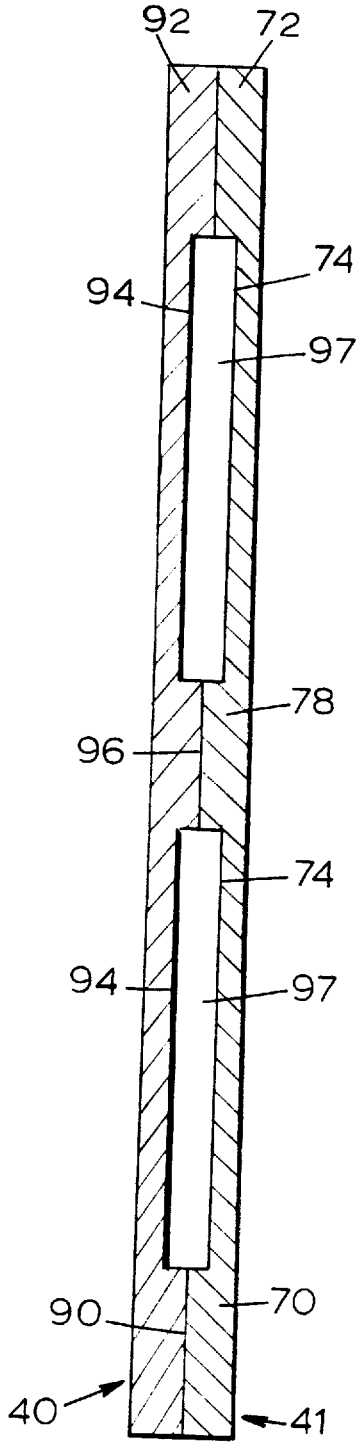
FIG. 8 is an enlarged cross sectional view of the assembled cooling element taken generally along the lines 8—8 of FIG. 7.

Referring now to FIGS. 7 and 8, the top cooling layer 40 may be a mirror image of the bottom cooling layer 41. Accordingly, the top and bottom cooling layers 40, 41 have identical footprints and outer peripheries. The outer and inner walls 70, 72, the relieved portion 74, and the ribs 78 (only one of the rib 78 is visible in FIG. 8) of the bottom layer 41 align with outer and inner walls 90, 92, a relieved portion 94 and ribs 96 of the top cooling layer 40 (only one of the ribs 96 is visible in FIG. 8). As with the relieved portion 74, the relieved portion 94 may be created using a photochemical etching process. The relieved portions 74 and 94 have outer walls and inner walls 72, 92 that are bonded together, thereby forming a channel 97 through which coolant may flow. The top cooling layer 40 and the bottom cooling layer 41 may be bonded together using brazing (e.g., vacuum, dip, active metal and the like), diffusion bonding, welding or friction bonding to form seals between the outer walls 70 and 90 and between the inner walls 72 and 92 to prevent coolant from escaping from the channel 97.

Figure 9:
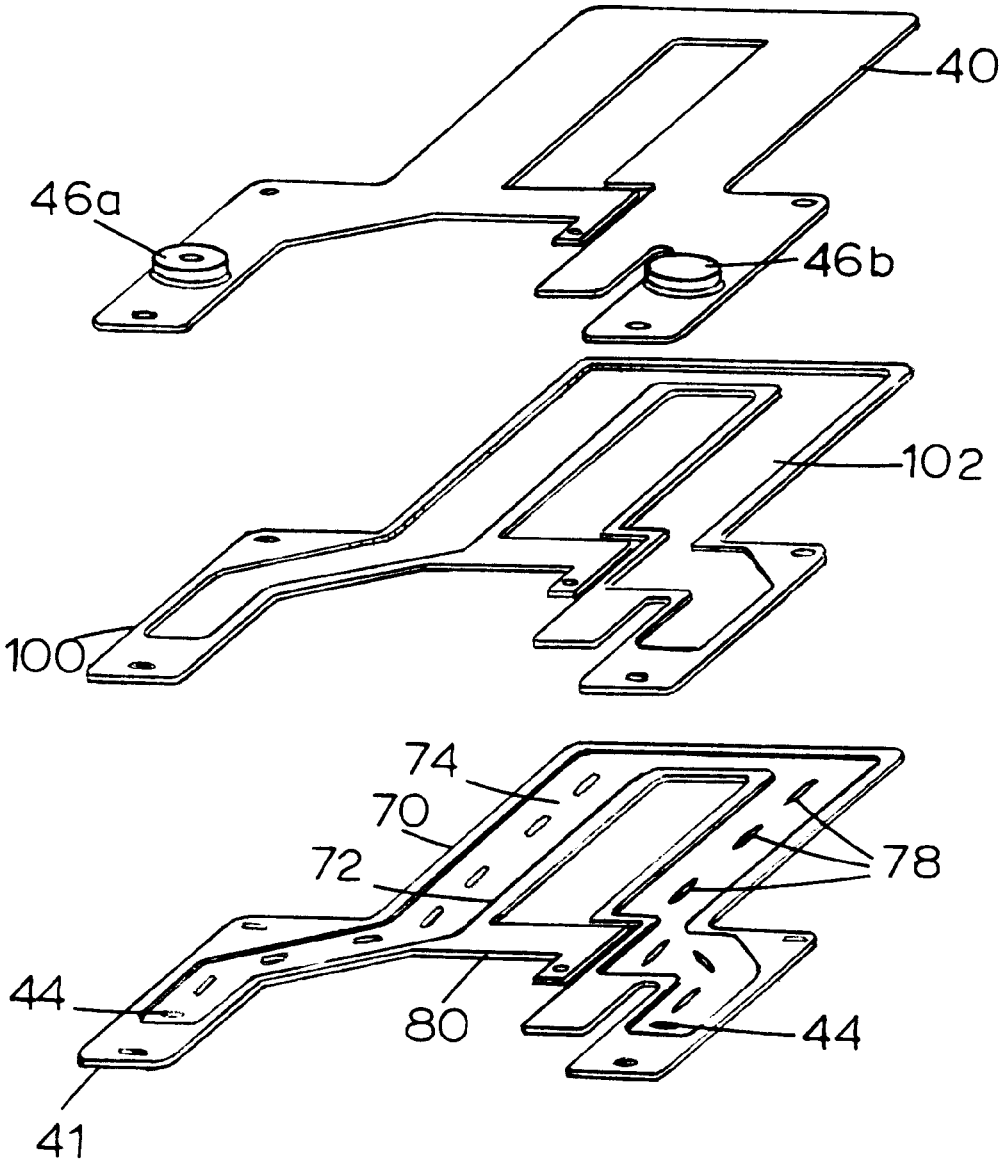
FIG. 9 is an exploded trimetric view of a three layer cooling element.

FIG. 9 illustrates an alternative embodiment wherein a cooling element 99 includes one or more middle cooling layers 100 between the top and bottom cooling layers 40, 41. The middle cooling layer 100 has an identical footprint to the top and the bottom cooling layers 40, 41. However, in contrast to the top and bottom cooling layers 40, 41, the middle cooling layer 100 does not have a relieved portion, but instead has an aperture 102 having an outer periphery substantially identical to the outer peripheries of the relieved portions 74, 94 of the top and bottom cooling layers 40, 41. The middle cooling layer 100 increases the depth of the channel 97 so that more coolant can flow therethrough, thereby increasing the cooling capacity of the cooling element 99 as compared to a cooling element having no middle cooling layer(s).

The foregoing embodiments presume that the cooling elements 26, 28 are electrically connected as part of the sets of primary windings 12, 16. However, in accordance with other aspects of the present invention, the cooling elements 26, 28 may be connected as part of the sets of secondary windings 20 or 22. Still further, the cooling elements 26, 28 may not be connected to either of the sets of primary windings 12, 16 or the sets of secondary windings 20, 22 and may be operated at an electrically neutral potential or any other potential. In this case, the cooling elements 26, 28 must be electrically insulated from the sets of windings 12, 14, 16, 20, 22 by one or more layers of the electrically insulative material such as polyimide, aramid or ceramic.

Figure 10:
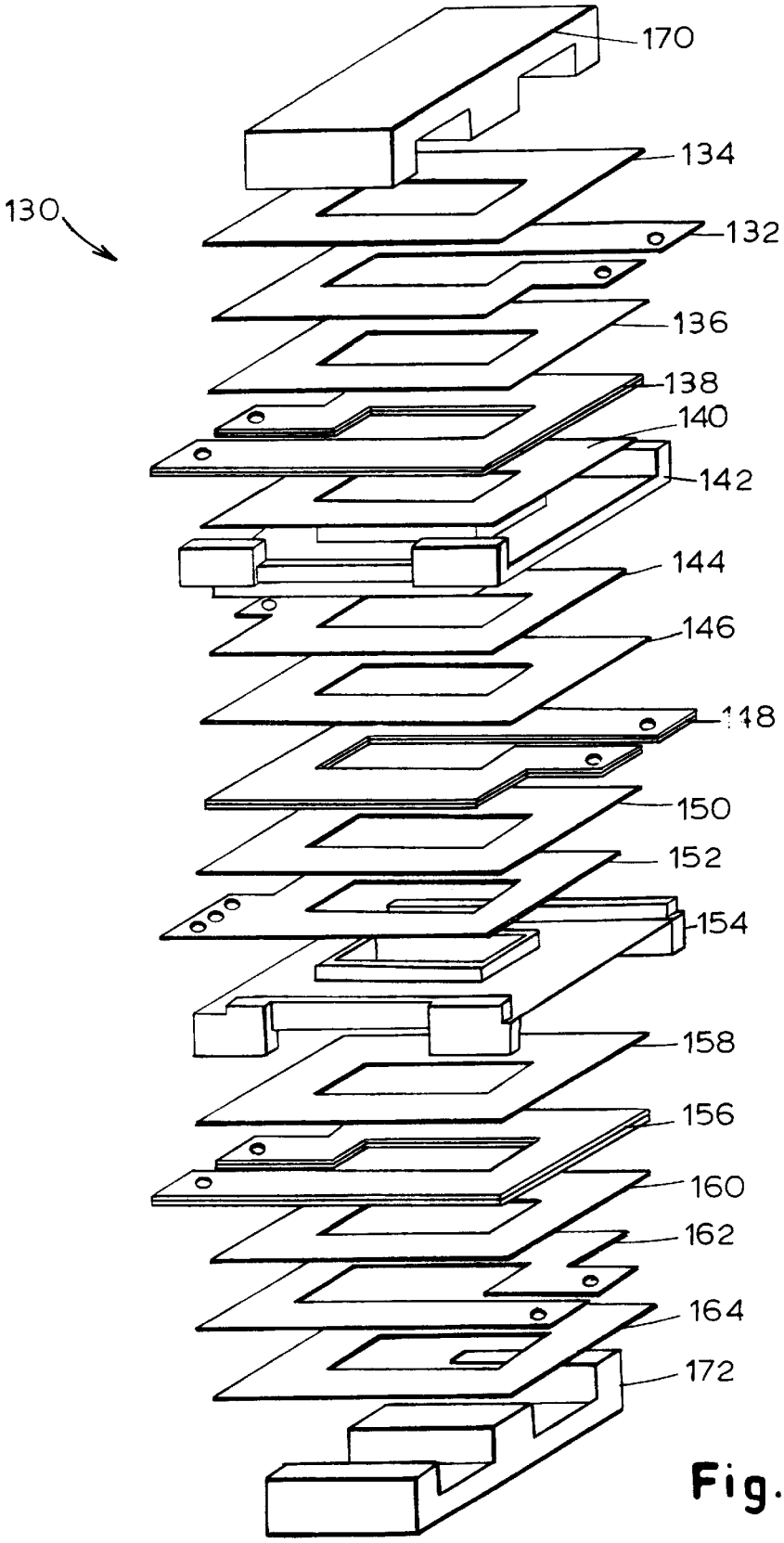
FIG. 10 is an exploded trimetric view of a PM transformer having integrated cooling according to a second embodiment of the present invention.
Figure 12:
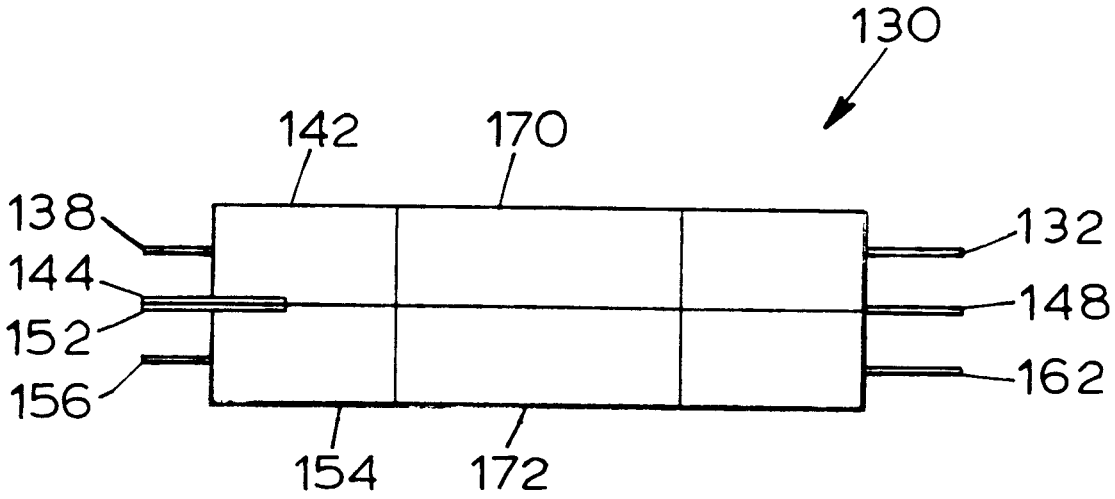
FIG. 12 is an elevational view of the PM transformer shown in FIG. 11.
Figure 11:
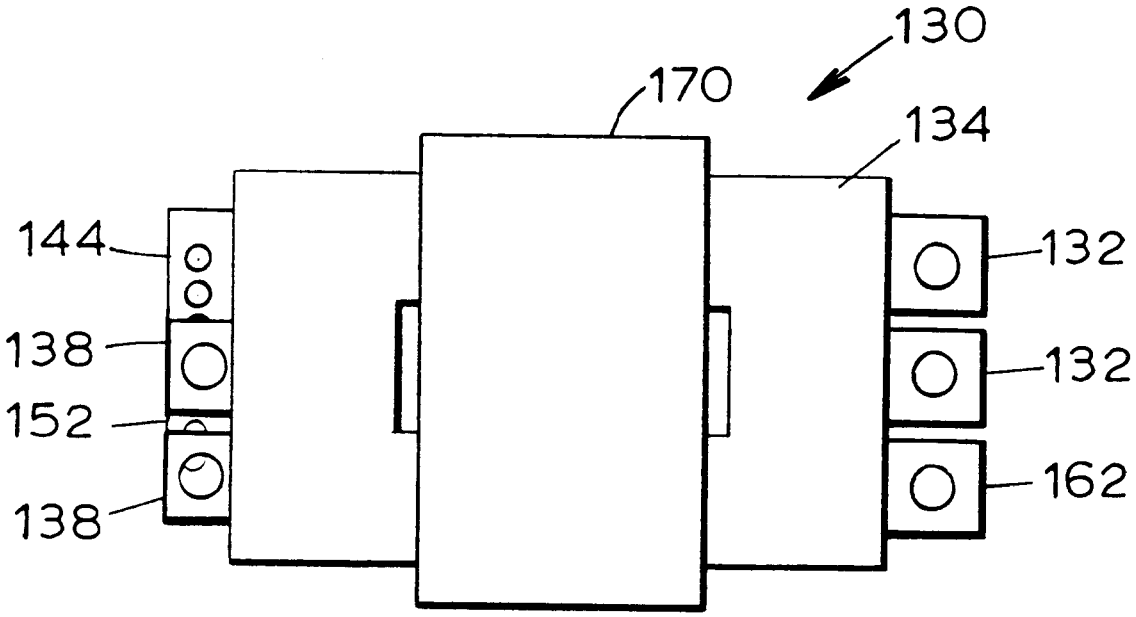
FIG. 11 is a plan view of the assembled PM transformer shown in FIG. 10.

Referring to FIGS. 10–12, a further embodiment of a PM transformer 130 has a first planar winding 132 disposed between electrically insulative layers 134 and 136. A first cooling element 138 is disposed between the electrically insulative layer 136 and a further electrically insulative layer 140. The insulative layers 134, 136 and 140, along with the first planar winding 132 and the first cooling element 138 are assembled onto a first bobbin member 142. The first bobbin member 142 is preferably made from an electrically insulative material and is used to mechanically support, retain and protect the various layers of the PM transformer 130.

A second planar winding 144 is assembled with an electrically insulative layer 146, a second cooling element 148, a further electrically insulative layer 150 and a third planar winding 152 onto a second bobbin member 154. The second bobbin member 154 and the components associated therewith are then assembled with the first bobbin member 142 and the components associated with the first bobbin member 142. A third cooling element 156 disposed between electrically insulative layers 158 and 160 and a fourth planar winding 162 disposed between dielectric insulators 160 and 164 are assembled into the second bobbin member 154. After the various layers of the PM transformer 130 have been assembled into the first and second bobbin members 142, 154 and the first and second bobbin members 142, 154 have been assembled together, core members 170 and 172 are installed around the layers 132–164. The core members 170, 172 may be conventional E-shaped ferrite members that magnetically couple the planar windings 132, 144, 152, 162 together. Preferably, the electrically insulative layers 134, 136, 140, 146, 150, 158, 160 and 164 are fabricated from polyimide, aramid or ceramic.

Certain ones of the planar windings 132, 144, 152, 162 may be connected together to form a transformer primary and the remaining windings may be connected together to form a transformer secondary. For example, the windings 132 and 144 may be connected together in series or parallel to form the transformer primary, while the windings 152 and 162 may be connected together in series or parallel to form the transformer secondary. Alternatively, the planar windings 132, 144, 152, 162 may be interconnected with one another in various fashions using conductive connections to provide various winding configurations. Additionally, while four planar windings 132, 144, 152, 162 are shown, a different number of windings and/or different winding shapes may be used and are within the scope of the present invention. In any event, the flux flow through the core members 170, 172 and the current flow through the planar windings 132, 144, 152, 162 cause power losses and heating. To reduce the heating caused by the power losses, the cooling elements 138, 148, 156 are disposed closely proximate the planar windings 132, 144, 152, 162 and the core members 170, 172 and are fabricated to accommodate the flow of liquid coolant that carries heat away from the PM transformer 130 during operation.

Although the PM transformer 130 shown in FIG. 10 includes numerous electrically insulative layers 134, 136, 140, 146, 150, 158, 160, 164, in certain embodiments, some or all of the electrically insulative layers may be omitted if the planar windings 132, 144, 152, 162 and/or cooling elements 138, 148, 156 are coated with an insulating coating such as a polyimide, aramid or ceramic or if there is no need to provide electrical insulation. For example, it may not be necessary to electrically insulate one or more of the cooling elements 138, 148, 156 from the planar windings, 132, 144, 152, 162.

Figure 13:
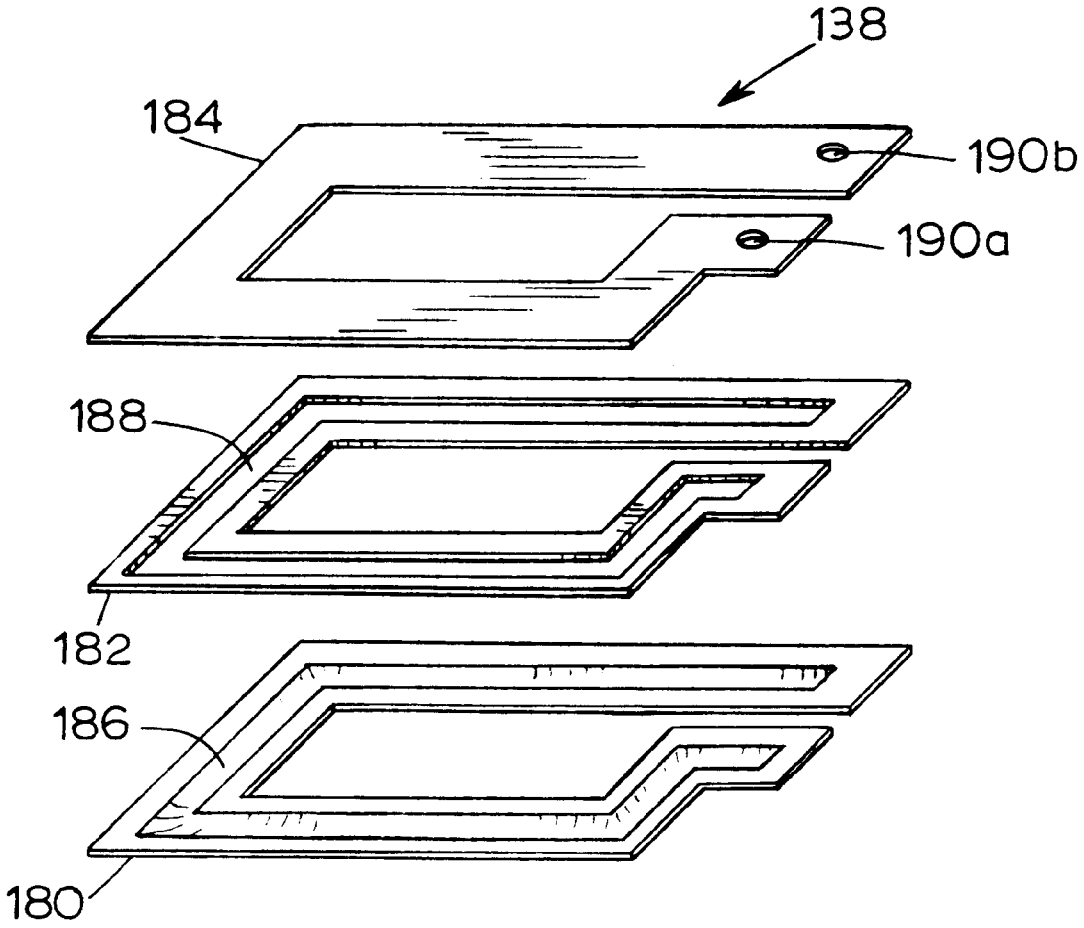
FIG. 13 is an exploded trimetric view of a cooling element used in the second embodiment of the PM transformer shown in FIGS. 10–12.

FIG. 13 is an exploded view of a single cooling element 138, it being understood that the cooling elements 148 and 156 are substantially identical thereto. In one embodiment, the cooling element 138 includes first, second and third generally planar cooling layers 180, 182 and 184, respectively. The cooling layers 180–184 may be fabricated from copper or one or more other thermally conductive materials and preferably have footprints that fit within the first and second bobbin members 142, 154. The first cooling layer 180 has a relieved portion 186 forming a trough having an outer periphery. The relieved portion 186 may be fabricated using a photochemical etching process.

The second cooling layer 182 has an or aperture 188 that has an outer periphery such that when the second cooling layer 182 is placed on top of the first cooling layer 180 and is aligned therewith, the outer periphery of the cooling layer 182 is coincident with the outer periphery of the cooling layer 180 and the walls forming the aperture 188 overlie the outer periphery of the relieved portion 186 to form a passage that accommodates liquid coolant. The third cooling layer 184 has coolant ports or holes 190*a*, 190*b* therethrough. The coolant ports 190*a*, 190*b* are located such that when the third cooling layer 184 is placed on and aligned with the first and second cooling layers 180, 182, the coolant ports 190*a*, 190*b* are in fluid communication with the aperture 188 and the relieved portion 186.

When the layers 180–184 of the cooling element 138 are assembled, the relieved portion 186, the aperture 188 and the coolant ports 190*a*, 190*b* are aligned such that coolant may be pumped into the coolant port 190*a*, travel around the circumference of the cooling element 138 in the passage formed by the relieved portion 186 and the aperture 188, and pumped out the second coolant port 190*b*. The cooling layers 180–184 may be bonded together or may be unbonded depending on the application of the cooling element 138 and the constraints on coolant leakage from the cooling element 138. Unbonded cooling layers 180–184 are most useful in applications in which coolant leakage may be tolerated. For example, unbonded cooling layers 180–184 may be used in an application wherein the PM transformer 130 is potted or otherwise retained in a housing that collects coolant that leaks from the cooling element 138. In this case, the layers 180–184 may be held together by a compressive force that minimizes leakage. In applications where coolant leakage is not tolerable, the cooling layers 180–184 may be bonded together in any suitable fashion such as brazing, diffusion bonding, welding, friction bonding or adhesive bonding.

As will be appreciated by those having ordinary skill in the art, the cooling element 138 shown in FIG. 13 could have additional layers identical to the second cooling layer 182 disposed between the first cooling layer 180 and the third cooling layer 184, in which case the volume of the coolant-carrying passage would be increased so that cooling capacity of the cooling element 138 is likewise increased. Moreover, the cooling element 138 may not have a second cooling layer 182 and may have only first and third cooling layers 180, 184, respectively. While the first cooling layer 180 is shown in FIG. 13 as having a relieved portion 186, the relieved portion 186 may be omitted in some embodiments and replaced with a planar (i.e., flat) layer. Similarly, in some embodiments, the third cooling layer 184 may also have a relieved portion.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed is:

1. A planar cooling device for use in a planar transformer, the planar cooling device comprising first and second cooling layers, wherein the first and second cooling layers include relieved portions having coincident outer peripheries that form a channel that contains a coolant.

2. A planar cooling device for use in a planar transformer, the planar cooling device comprising first and second cooling layers, wherein one of the first and second cooling layers includes a relieved portion having an outer perimeter and forming a channel that contains a coolant, the planar cooling device further comprising a third cooling layer having an aperture therein, the third layer being disposed between the first and second cooling layers, wherein the aperture has an outer periphery essentially coincident with the outer periphery of the relieved portion.

3. A planar magnetic device comprising:

a planar conductive winding; and a planar cooling element separate from the planar conductive winding, wherein the planar cooling element further comprises first and second cooling layers, the planar cooling element having a passage therethrough to accommodate a flow of a coolant, the planar cooling element being disposed adjacent the planar conductive winding, wherein the planar cooling element further comprises a third cooling layer, the third cooling layer being disposed between the first and second cooling layers and having an aperture therein, wherein one of the first, second, and third cooling layers includes a relieved portion having an outer periphery and forming a channel to allow the coolant to flow, wherein the aperture of the third cooling layer has an outer periphery essentially coincident with the outer periphery of the relieved portion.

4. A planar magnetic device comprising:

a planar conductive winding; and a planar cooling element separate from the planar conductive winding, the planar cooling element having a passage therethrough to accommodate a flow of a coolant, the planar cooling element being disposed adjacent the planar conductive winding, wherein the first and second cooling layers each include relieved portions having coincident outer peripheries forming a channel to allow the coolant to flow.

* * * * *